US008378927B2

(12) United States Patent
Lee et al.

(10) Patent No.: US 8,378,927 B2
(45) Date of Patent: Feb. 19, 2013

(54) APPARATUS FOR DRIVING ELECTROCHROMIC DEVICE AND METHOD THEREOF

(75) Inventors: Tae-Joong Lee, Daejeon (KR); Jae-Dong Pakr, Daejeon (KR); Hyun-Woo Shin, Gwacheon-si (KR)

(73) Assignee: LG Chem, Ltd., Seoul (KR)

( * ) Notice: Subject to any disclaimer, the term of this patent is extended or adjusted under 35 U.S.C. 154(b) by 1020 days.

(21) Appl. No.: 12/310,733

(22) PCT Filed: Sep. 3, 2007

(86) PCT No.: PCT/KR2007/004236

§ 371 (c)(1),
(2), (4) Date: Mar. 5, 2009

(87) PCT Pub. No.: WO2008/030018

PCT Pub. Date: Mar. 13, 2008

(65) Prior Publication Data

US 2010/0085624 A1 Apr. 8, 2010

(30) Foreign Application Priority Data

Sep. 6, 2006 (KR) ..... 10-2006-0085610

(51) Int. Cl.
*G09G 3/19* (2006.01)

(52) U.S. Cl. ..... 345/49; 345/105; 359/265

(58) Field of Classification Search ..... 345/49, 345/105; 359/265–275
See application file for complete search history.

(56) References Cited

U.S. PATENT DOCUMENTS

| | | | | |
|---|---|---|---|---|
| 4,349,818 | A * | 9/1982 | Kaneko et al. | 345/105 |
| 5,581,406 | A * | 12/1996 | Kobayashi et al. | 359/604 |
| 6,170,968 | B1 * | 1/2001 | Caswell | 362/469 |
| 6,330,101 | B1 | 12/2001 | Yamamoto et al. | |
| 2005/0169069 | A1 | 8/2005 | Luk | |
| 2006/0098264 | A1 * | 5/2006 | Park | 359/265 |
| 2006/0158410 | A1 * | 7/2006 | Fujine | 345/89 |
| 2006/0209007 | A1 * | 9/2006 | Pyo et al. | 345/105 |

FOREIGN PATENT DOCUMENTS

| | | |
|---|---|---|
| EP | 1 111 572 A2 | 6/2001 |
| JP | 11-231994 | 8/1999 |
| JP | 3-434717 | 8/2003 |

* cited by examiner

*Primary Examiner* — Hong Zhou
(74) *Attorney, Agent, or Firm* — McKenna Long & Aldridge LLP

(57) ABSTRACT

An apparatus for driving an electrochromic device (ECD) includes a driving volt age output unit for selectively applying a coloring or decoloring voltage between upper and lower electrodes of an ECD; a timer for counting an applying time of the coloring or decoloring voltage in a memory type driving mode and then outputting a voltage application completion signal after the counted time exceeds a preset time, the timer bypassing the counting operation in a non-memory type driving mode; and a driving controller for selectively inputting a coloring or decoloring signal to the driving voltage output unit such that the driving voltage output unit is controlled to output a coloring or decoloring voltage corresponding to the signal, the driving controller receiving the voltage application completion signal to stop the input of the coloring or decoloring signal. Thus, memory type and non-memory type ECDs may be driven automatically using only one apparatus.

15 Claims, 6 Drawing Sheets

APPARATUS FOR DRIVING ELECTROCHROMIC DEVICE AND METHOD THEREOF

TECHNICAL FIELD

The present invention relates to an apparatus for driving an electrochromic device and its control method, and more particularly to an apparatus for driving an electrochromic device, which may drive memory type and non-memory type electrochromic devices operated in different ways, and its control method.

BACKGROUND ART

An electrochromic device (ECD) is a display device using electrochromic material that is colored or decolored by means of electrochemical oxidation and deoxidation according to an applying direction of electric current. The ECD keeps a transparent color if current is not applied thereto, but the ECD exhibits an inherent color according to the kind of electrochromic material if current is applied thereto. In addition, if the current direction is reversed, the color of the electrochromic material is decolored and thus restored into the transparent color. The ECD having such properties is widely used for mirrors and sunroofs of vehicle, smart windows and outside displays.

FIG. 1 schematically shows a basic configuration of an ECD. Referring to FIG. 1, the ECD 10 includes a first glass substrate 20 on which an upper electrode 30 made of transparent material and having an electrochromic material layer 40 is laminated, a second glass substrate 80 on which a lower electrode 70 made of transparent material and having an ion storage layer 60 is laminated such that the second glass substrate 80 faces the first glass substrate 20, and an electrolytic layer 50 injected between the electrochromic material layer 40 and the ion storage layer 60.

The ECD 10 configured as mentioned above is colored when a voltage is applied between the upper electrode 30 and the lower electrode 70 to flow current from the ion storage layer 60 to the electrochromic material layer 40. Also, the ECD 10 is decolored when a voltage opposite to the coloring case is applied thereto to flow current from the electrochromic material layer 40 to the ion storage layer 60.

Meanwhile, the ECD is classified into a memory type ECD that keeps a colored or decolored state once being colored and decolored though voltage is applied between the upper and lower electrodes, and a non-memory type ECD that keeps a colored or decolored state after being colored or decolored only when voltage is continuously applied between the upper and lower electrodes.

As mentioned above, the ECD has entirely different voltage applying patterns depending on its type, so driving devices for memory type ECD and non-memory type ECD should be separately developed and used, cumbersomely, in the past.

DISCLOSURE

Technical Problem

The present invention is designed in consideration of the above problems, and therefore it is an object of the invention to provide an ECD driving apparatus capable of driving both memory type ECD and non-memory type ECD having entirely different voltage applying patterns, and particularly capable of easily controlling a coloring or decoloring time when driving a memory ECD; and its control method.

Technical Solution

In order to accomplish the above object, the present invention provides an apparatus for driving an electrochromic device (ECD), which includes a driving voltage output unit for selectively applying a coloring voltage or a decoloring voltage between upper and lower electrodes of an ECD; a timer for counting an applying time of the coloring or decoloring voltage in a memory type driving mode and then outputting a voltage application completion signal after the counted time exceeds a preset time, the timer bypassing the counting operation in a non-memory type driving mode; and a driving controller for selectively inputting a coloring signal or a decoloring signal to the driving voltage output unit such that the driving voltage output unit is controlled to output a coloring or decoloring voltage corresponding to the signal, the driving controller receiving the voltage application completion signal to stop the input of the coloring or decoloring signal.

Preferably, the driving voltage output unit includes an upper electrode output unit for applying a high level voltage for the coloring signal and a low level voltage for the decoloring signal to the upper electrode of the ECD; and a lower electrode output unit for applying a low level voltage for the coloring signal and a high level voltage for the decoloring signal to the lower electrode of the ECD.

Preferably, the driving controller outputs an electrode opening signal to the driving voltage output unit in response to the voltage application completion signal, and in response to the electrode opening signal, the driving voltage output unit floats the upper and lower electrodes to open the electrodes of the ECD.

Preferably, the timer is switched into a continuing time setting timer in the memory type driving mode and switched into a bypass timer in the non-memory driving mode.

In the present invention, the timer may include includes a coloring timer for counting a voltage applying time when the coloring voltage is applied to the upper and lower electrodes of the ECD and then outputting a voltage application completion signal in case the counted voltage applying time reaches a preset coloring continuing time in the memory type driving mode, the coloring timer bypassing the time counting operation in the non-memory type driving mode; and a decoloring timer for counting a voltage applying time when the decoloring voltage is applied to the upper and lower electrodes of the ECD and then outputting a voltage application completion signal when the counted voltage applying time reaches a preset decoloring continuing time in the memory type driving mode, the decoloring timer bypassing the time counting operation in the non-memory type driving mode.

Preferably, the coloring timer includes a voltage input terminal to which the coloring voltage applied to the ECD is detected and input; a continuing time setting timer for counting a time from a voltage applying point when the coloring voltage is applied and then outputting a voltage application completion signal when the counted time reaches a preset coloring continuing time; a bypass timer for bypassing the time counting operation and not outputting a voltage application completion signal though the coloring voltage is applied; a timer selection switch for switching the voltage input terminal into the continuing time setting timer in the memory type driving mode and switching the voltage input terminal into the bypass timer in the non-memory driving mode according to the control of the driving controller; and a signal output terminal for applying the voltage application completion signal to the driving controller.

Preferably, the decoloring timer includes a voltage input terminal to which the decoloring voltage applied to the ECD is detected and input; a continuing time setting timer for counting a time from a voltage applying point when the decoloring voltage is applied and then outputting a voltage application completion signal when the counted time reaches a preset decoloring continuing time; a bypass timer for bypassing the time counting operation and not outputting a voltage application completion signal though the decoloring voltage is applied; a timer selection switch for switching the voltage input terminal into the continuing time setting timer in the memory type driving mode and switching the voltage input terminal into the bypass timer in the non-memory driving mode according to the control of the driving controller; and a signal output terminal for applying the voltage application completion signal to the driving controller.

The apparatus for driving an ECD according to the present invention may further include a memory of storing ECD type information, and the driving controller may read the ECD type information stored in the memory and then switch the timer into a continuing time setting timer in case the ECD is a memory type ECD and switch the timer into bypass timer in case the ECD is a non-memory type ECD.

In another aspect of the present invention, there is also provided an apparatus for driving an ECD, which includes an ECD having upper and lower electrodes; and an E CD driving module for selecting a driving mode according to a type of the ECD and receiving an ECD control signal to apply a coloring or decoloring voltage between the upper and lower electrodes of the ECD, the ECD driving module counting an applying time of the coloring or decoloring voltage and then stopping the application of the coloring or decoloring voltage when the counted applying time reaches a preset continuing time in a memory type driving mode, the ECD driving module keeping the application of the coloring or decoloring voltage in a non-memory type driving mode.

In order to accomplish the above object, in still another aspect of the present invention, there is also provided an ECD driving control method using a timer that counts an applying time of a coloring or decoloring voltage applied between upper and lower electrodes of an ECD and then outputs a voltage application completion signal when the counted applying time exceeds a preset time in a memory type driving mode, and bypasses the counting operation in a non-memory driving mode, the method including: (a) selecting a driving mode of the timer according to a type of the ECD; (b) selectively applying a coloring or decoloring voltage between the upper and lower electrodes of the ECD; (c) monitoring whether the timer outputs the voltage application completion signal; and (d) stopping the application of the coloring or decoloring voltage when the voltage application completion signal is output from the timer, and keeping the application of the coloring or decoloring voltage when the counting operation of the timer is bypassed.

Preferably, the step (a) includes (a1) reading a type of the ECD stored in a memory; and (a2) setting a driving mode of the timer to a continuing time setting timer or a by pass timer according to the read type of the ECD.

Preferably, the step (b) includes (b1) receiving an ECD control signal; (b2) deter mining whether the ECD control signal is a coloring control signal or a decoloring control signal; and (b3) applying a coloring voltage between the upper and lower electrodes of the ECD in case the ECD control signal is a coloring control signal, and applying a decoloring voltage between the upper and lower electrodes of the ECD in case that the ECD control signal is a decoloring control signal.

Preferably, in the step (b3), in case the ECD control signal is a coloring control signal, a high level voltage and a low level voltage are respectively applied to the upper and lower electrodes of the ECD, while, in case the ECD control signal is a decoloring control signal, a low level voltage and a high level voltage are respectively applied to the upper and lower electrodes of the ECD.

In the present invention, the ECD control signal may be received from a switch or a microcontroller.

In further another aspect of the present invention, there is also provided an ECD driving control method, which includes (a) receiving an ECD type signal of an ECD and selecting a driving mode of the ECD; (b) receiving an ECD control signal and determining whether the ECD control signal is a coloring control signal or a decoloring control signal; (c) applying a coloring voltage to upper and lower electrodes of the ECD in case the ECD control signal is a coloring control signal, and applying a decoloring voltage to the upper and lower electrodes of the ECD in case the ECD control signal is a decoloring control signal; and (d) counting an applying time of the coloring or decoloring voltage and then stopping the application of the coloring or decoloring voltage when the counted applying time reaches a preset time in case the driving mode is a memory type driving mode, and keeping the application of the coloring or decoloring voltage in case the driving mode is a non-memory driving mode.

DESCRIPTION OF DRAWINGS

These and other features, aspects, and advantages of preferred embodiments of the present invention will be more fully described in the following detailed description, taken accompanying drawings. In the drawings.

REFERENCE NUMERALS OF ESSENTIAL PARTS IN THE DRAWINGS

Figure 1:
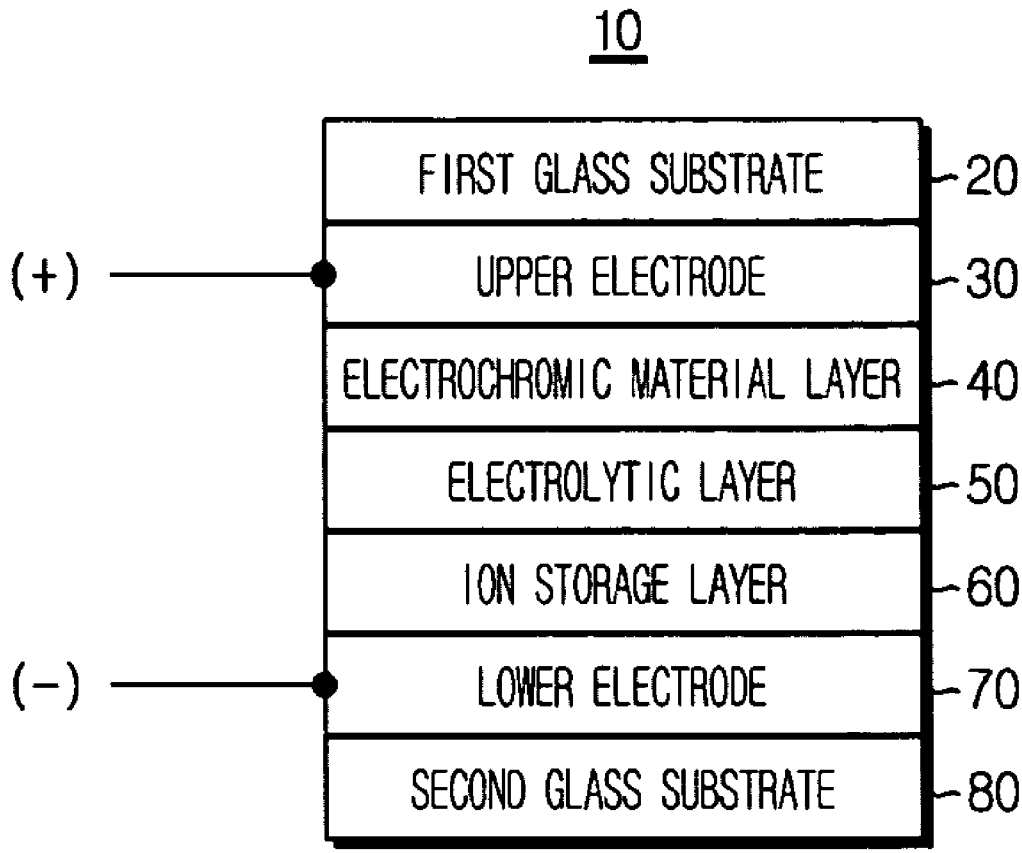
FIG. 1 is a schematic view showing a general configuration of an ECD.

100: ECD driving apparatus
110: power source
120: driving voltage output unit
121: upper electrode output unit

122: lower electrode output unit
130: timer
131: coloring timer
132: decoloring timer
140: driving controller
ECD: electrochromic device

BEST MODE

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 2:
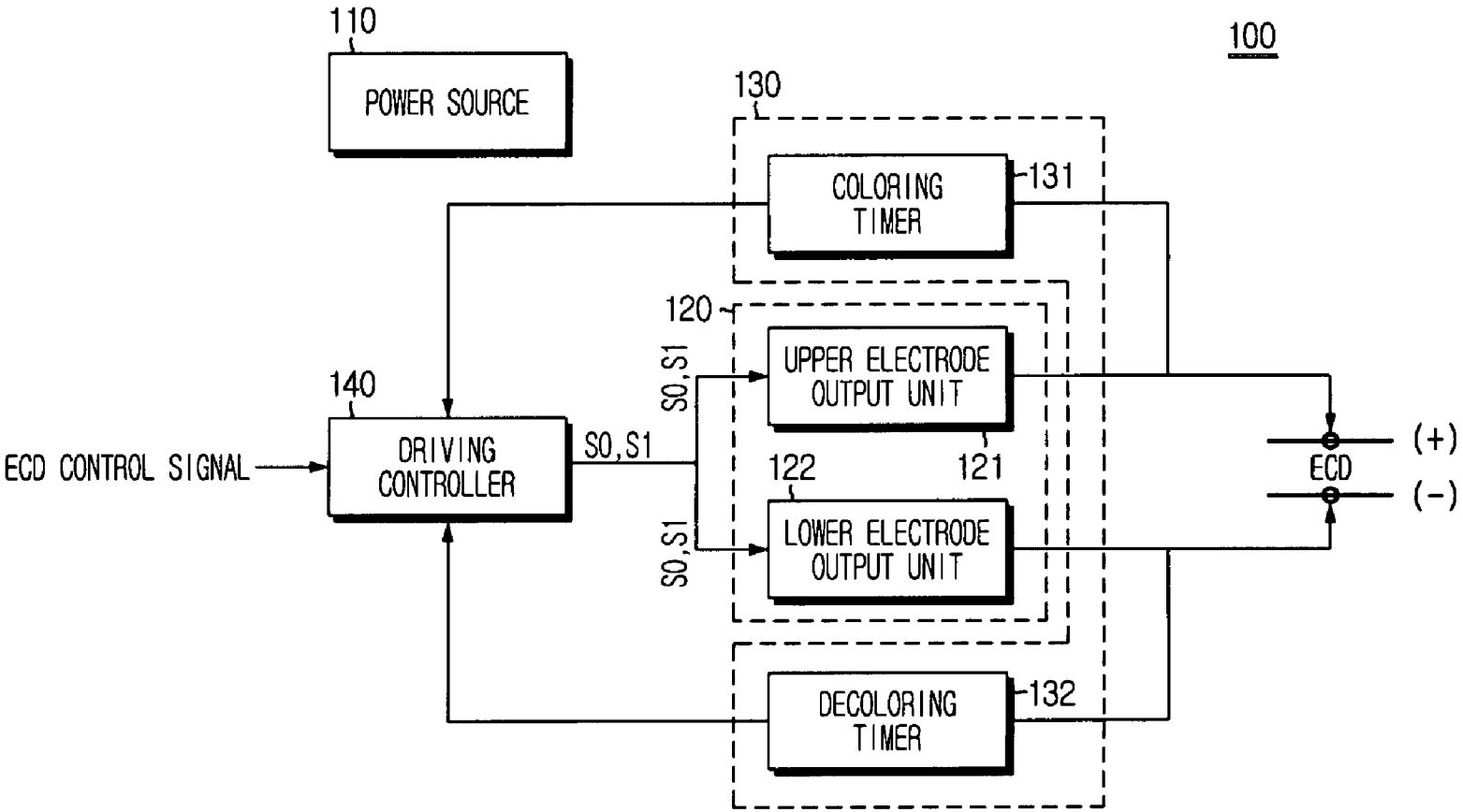
FIG. 2 is a block diagram schematically showing an ECD driving apparatus according to a preferred embodiment of the present invention.

FIG. 2 is a schematic block diagram showing an ECD driving apparatus according to a preferred embodiment of the present invention.

Referring to FIG. 2, an ECD (electrochromic device) driving apparatus 100 according to the present invention includes a power source 110 for supplying operation power to a logic circuit provided in the apparatus and electrode power to an ECD, a driving voltage output unit 120 for selectively applying a coloring or decoloring voltage between upper and lower electrodes of the ECD, a timer 130 for counting an applying time of the coloring or decoloring voltage and then outputting a voltage application completion signal when the counted applying time exceeds a preset time in a memory type driving mode while bypassing the counting operation and not outputting a voltage application completion signal in a non-memory driving mode, and a driving controller 140 for selectively inputting a coloring or decoloring signal to the driving voltage output unit 120 such that the driving voltage output unit 120 is controlled to output a coloring or decoloring voltage in correspondence with the input signal and receiving the voltage application completion signal to stop the input of the coloring or decoloring signal.

The power source 110 receives various powers (5 to 25V) from outside and then supplies a VCC voltage of 0.5 to 3V to the ECD to cope with various kinds of ECDs regardless of their types (e.g., memory type and non-memory type). Meanwhile, a power supply line used for supplying various operation powers of various logic circuits in the apparatus and electrode power of the ECD is well known in the art, and thus not illustrated in the drawings.

The driving voltage output unit 120 reverses the voltage applied between the upper and lower electrodes of the ECD into a coloring or decoloring voltage according to the coloring or decoloring signal input from the driving controller 140.

For example, in case a coloring signal is input from the driving controller 140, the driving voltage output unit 120 applies a high level voltage (VCC) to the upper electrode of the ECD and a low level voltage (GND) to the lower electrode. On the contrary, in case a decoloring signal is input from the driving controller 140, the driving voltage output unit 120 applies a low level voltage (GND) to the upper electrode and a high level voltage (VCC) to the lower electrode.

Preferably, for performing the above voltage applying operation, the driving voltage output unit 120 includes an upper electrode output unit 121 for outputting a high level voltage in a coloring mode and a low level voltage in a decoloring mode to the upper electrode of the ECD, and a lower electrode output unit 122 for outputting a high level voltage in a decoloring mode and a low level voltage in a coloring mode to the lower electrode of the ECD.

Figure 3:
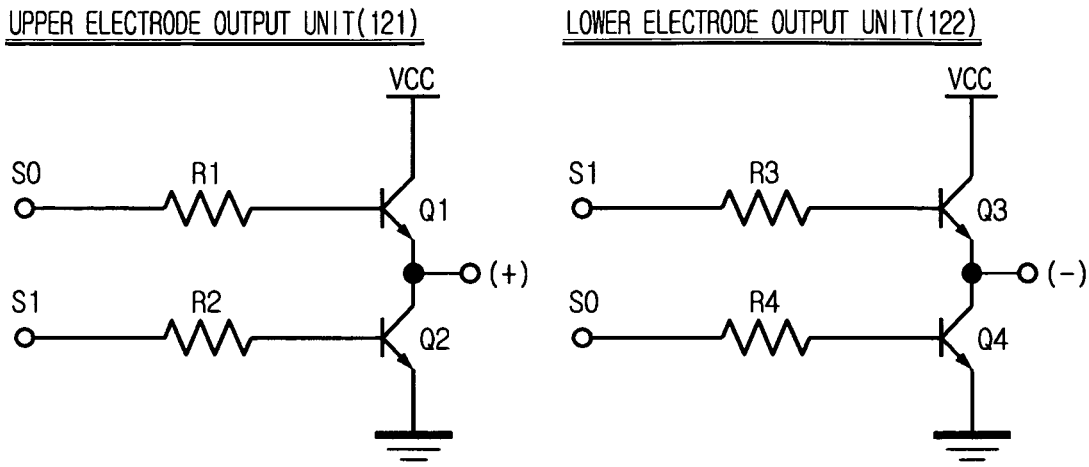
FIG. 3 is a detailed circuit diagram showing a driving voltage output unit according to a preferred embodiment of the present invention.

FIG. 3 shows circuit configurations of the upper electrode output unit 121 and the lower electrode output unit 122 according to a preferred embodiment of the present invention.

Referring to FIG. 3, the upper electrode output unit 121 includes two transistors Q1, Q2 that conduct push-pull operation by combination of signals S0 and S1 input from the driving controller 140 through resistances R1, R2 to apply a voltage to the upper electrode of the ECD.

Meanwhile, the lower electrode output unit 122 includes two transistors Q3, Q4 that conduct push-pull operation, oppositely to the upper electrode output unit 121, by combination of signals S0 and S1 input from the driving controller 140 through resistances R3, R4 to apply a voltage to the lower electrode of the ECD.

The following table 1 shows voltage levels applied to the upper and lower electrodes of the ECD respectively by the upper and lower electrode output units 121, 122 by combination of signals S0 and S1 input from the driving controller 140.

TABLE 1

| S0 | S1 | Upper electrode (+) | Lower electrode (−) | |
|---|---|---|---|---|
| 1 | 0 | VCC | GND | Coloring voltage |
| 0 | 1 | GND | VCC | Decoloring voltage |
| 0 | 0 | floating | floating | Opening voltage |

Seeing the table 1, in case the signals output from the driving controller 140 are in condition that S0='1'and S1='0' (namely, in case of a coloring signal), a high level voltage (VCC) is applied to the upper electrode of the ECD, and a low level voltage (GND) is applied to the lower electrode. On the contrary, in case the signals output from the driving controller 140 are in condition that S0='0'and S1='1'(namely, in case of a decoloring signal), a low level voltage (GND) is applied to the upper electrode of the ECD, and a high level voltage (VCC) is applied to the lower electrode. Meanwhile, in case the signals output from the driving controller 140 are in condition that S0='0'and S1='0'(namely, in case of a voltage opening signal), the upper and lower electrodes of the ECD are all floated and thus opened.

Referring to FIG. 2 again, the timer 130 is operated in different ways in case the ECD is a memory type or a non-memory type.

In more detail, in case the ECD is a memory type ECD, the timer 130 operates as a continuing time setting timer. Thus, the timer 130 counts a time from the point when the coloring or decoloring voltage is output to both electrodes of the ECD from the driving voltage output unit 120. Then, if the counted time reaches a preset coloring or decoloring continuing time, the timer 130 outputs a voltage application completion signal to the driving controller 140. Then, the driving controller 140 stops the output of the coloring or decoloring signal applied to the driving voltage output unit 120, and then applies an electrode opening signal to the driving voltage output unit 120 to float both electrodes of the ECD. Then, both electrodes of the ECD are floated due to the driving voltage output unit 120 and thus come into neither high (VCC) nor low (GND) state, namely being opened, so the electrodes are opened.

On the contrary, if the ECD is a non-memory ECD, the timer 130 operates as a bypass timer. Thus, though a coloring or decoloring voltage is output to both electrodes of the ECD from the driving voltage output unit 120, the timer 130 does not count time.

Thus, the timer 130 does not output a voltage application completion signal to the driving controller 140. As a result, the driving controller 140 continuously outputs the coloring or decoloring signal to the driving voltage output unit 120, so the coloring or decoloring voltage is continuously applied to both electrodes of the ECD.

Preferably, the timer 130 includes a coloring timer 131 and a decoloring timer 132. In a memory type driving mode, the coloring timer 131 initiates a time counting operation when a high level voltage (VCC) is output from the upper electrode output unit 121. Then, if the counted time reaches a preset coloring continuing time, the coloring timer 131 outputs a voltage application completion signal to the driving controller 140. In addition, in a non-memory type driving mode, the coloring timer 131 acts as a bypass timer and thus does not output a voltage application completion signal to the driving controller 140. On the while, in a memory type driving mode, the decoloring timer 132 initiates a time counting operation when a high level voltage (VCC) is output from the lower electrode output unit 122. If the counted time reaches a preset decoloring continuing time, the decoloring timer 132 outputs a voltage application completion signal to the driving controller 140. In addition, in a non-memory type driving mode, the decoloring timer 132 acts as a bypass timer and thus does not output a voltage application completion signal to the driving controller 140.

Figure 4:
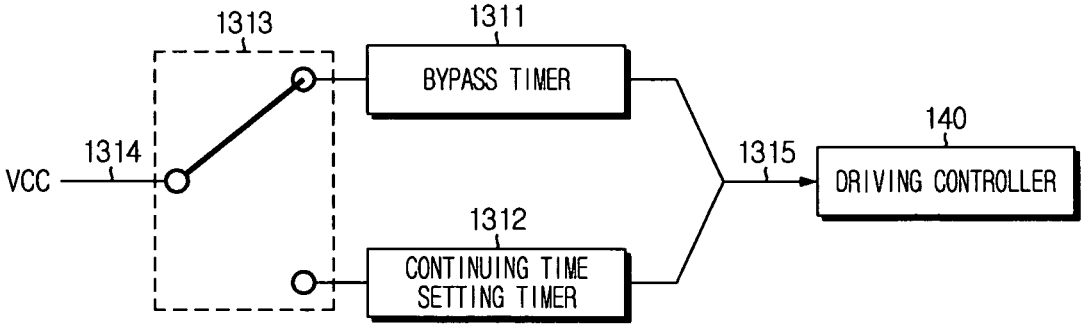
FIG. 4 is a circuit diagram schematically showing a coloring timer according to a preferred embodiment of the present invention.

FIG. 4 shows a circuit configuration of the coloring timer 131 according to a preferred embodiment of the present invention in more detail.

Referring to FIG. 4, the coloring timer 131 includes a bypass timer 1311, a continuing time setting timer 1312, a voltage input terminal 1314 to which a high level voltage (VCC) applied to the upper electrode of the ECD is input, a timer selection switch 1313 for selectively switching two timers 1311, 1312 according to the control of the driving controller 140, and a signal output terminal 1315 for applying a voltage application completion signal output from the continuing time setting timer 1312 to the driving controller 140.

In a memory type driving mode, the timer selection switch 1313 applies a high level voltage (VCC) of the upper electrode output unit 121 applied through the voltage input terminal 1314 to the continuing time setting timer 1312. Also, in a non-memory driving mode, the timer selection switch 1313 applies the high level voltage (VCC) to the bypass timer 1311. If the high level voltage (VCC) is applied to the continuing time setting timer 1312, the continuing time setting timer 1312 initiates a time counting operation. If the counted time reaches a preset coloring continuing time, the continuing time setting timer 1312 outputs a voltage application completion signal to the driving controller 140 through the signal output terminal 1315. The bypass timer 1311 bypasses the time counting operation though a high level voltage (VCC) is applied by the timer selection switch 1313. Thus, the bypass timer 1311 does not output a voltage application completion signal to the driving controller 140 through the signal output terminal 1315.

The decoloring timer 132 according to the present invention has a circuit configuration substantially identically to the coloring timer 131, except that a high level voltage (VCC) output from the lower electrode output unit 122 through an input terminal is applied through a voltage input terminal, so it is not explained in detail here.

Meanwhile, it would be apparent to those having ordinary skill in the art that the coloring and decoloring timers 131, 132 may be integrated into an inner circuit of the driving controller 140, differently from the above. Also, the coloring and decoloring timers 131, 132 may be realized in various logic or analog circuits well known in the art. Thus, specific examples of the coloring and decoloring timers 131, 132 are not explained here.

Referring to FIG. 2 again, the driving controller 140 receives an ECD control signal for controlling coloring and decoloring of the ECD and then outputs a coloring or decoloring signal to the driving voltage output unit 120 according to the ECD control signal. The ECD control signal may be a coloring bit, a decoloring bit, or their combination. This ECD control signal may be output from a mechanical or electronic switch (not shown) that selectively outputs a coloring or decoloring bit. In addition, a continuous bit string may be output from a microcontroller (not shown) to color or decolor an ECD in a successive order according to a predetermined program. However, the present invention is not limited thereto.

The driving controller 140 outputs to the driving voltage output unit 120 a coloring signal in case the ECD control signal is a coloring bit, a decoloring signal in case of a decoloring bit, or a combination of coloring and decoloring signals correspondingly in case of a combination of coloring and decoloring bits.

Preferably, the driving controller 140 stores information about the kind of ECD in a nonvolatile memory included therein. Thus, if power is applied from the power source 110, the driving controller 140 reads the kind of ECD stored in the memory and then switches a function of the timer 130 into any one of a continuing time setting timer and a bypass timer.

In more detail, in case the ECD is a memory type ECD, the driving controller 140 controls the timer selection switches of the coloring timer 131 and the decoloring timer 132 such that the coloring timer 131 and the decoloring timer 132 are switched into continuing time setting timers. On the contrary, in case the ECD is a non-memory type ECD, the driving controller 140 controls the timer selection switches of the coloring timer 131 and the decoloring timer 132 such that the coloring timer 131 and the decoloring timer 132 are switched into bypass timers.

In case a voltage application completion signal is output from the timer 130 in a memory type driving mode, the driving controller 140 outputs an electrode opening signal (S0='0', S1='0') to the driving voltage output unit 120. Accordingly, the upper and lower electrodes of the ECD are floated by the driving voltage output unit 120 and thus both electrodes are opened. Accordingly, the colored or decolored state of the ECD is continued.

Meanwhile, in a non-memory type driving mode, a voltage application completion signal is not output from the timer 130. Thus, the driving controller 140 continuously outputs a coloring or decoloring signal to the driving voltage output unit 120. Accordingly, the driving voltage output unit 120 continuously applies a coloring or decoloring voltage to the upper and lower electrodes of the ECD to keep the colored or decolored state of the ECD.

The driving controller 140 may be realized using a logic IC, an analog IC, or their combination. It would be apparent to those having ordinary skill in the art that detailed circuit design of the driving controller may be easily made from the understanding of the operation of the driving controller 140, explained above.

Figure 5:
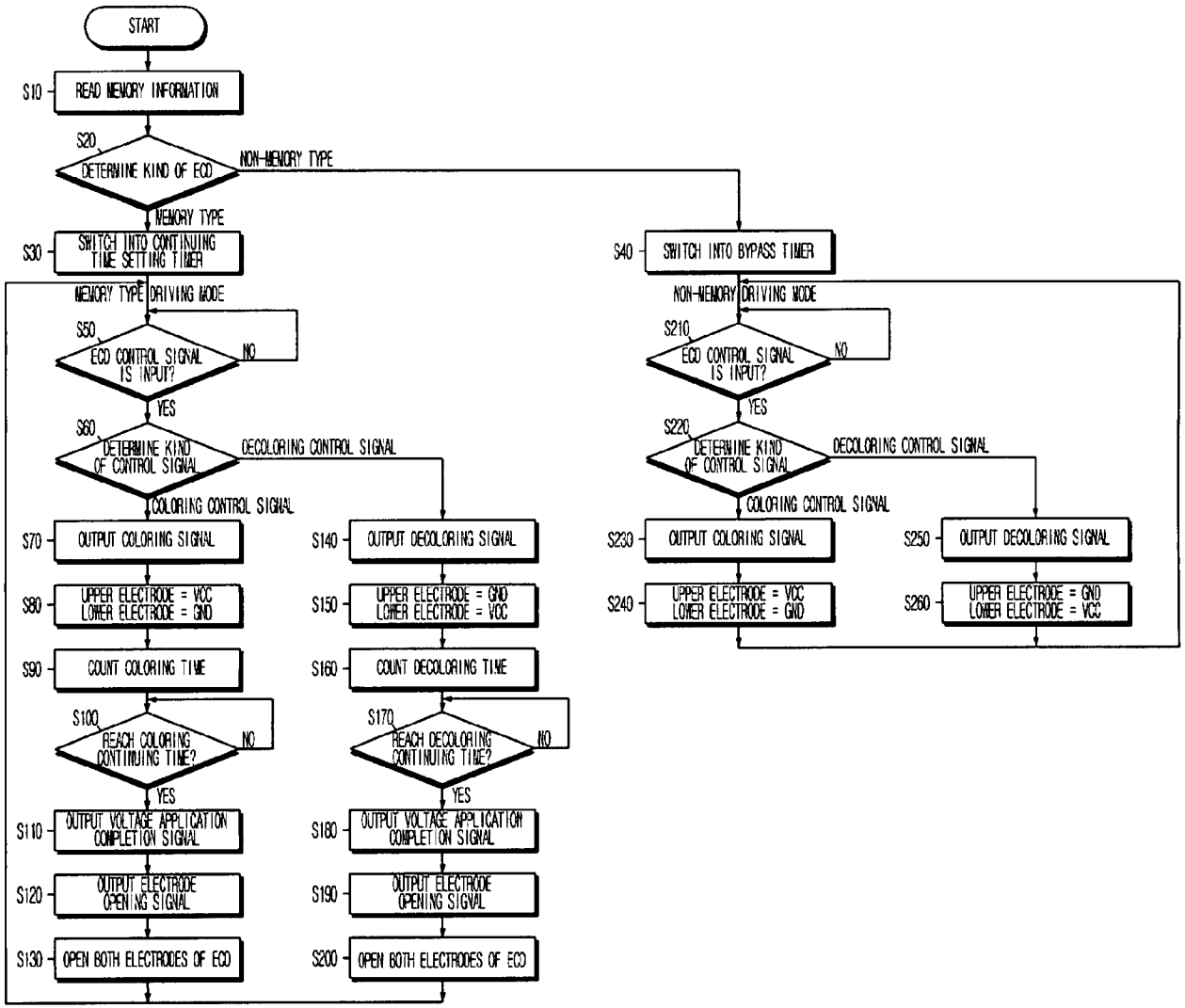
FIG. 5 is a flowchart illustrating an ECD driving control method according to a preferred embodiment of the present invention.

FIG. 5 is a flowchart illustrating an ECD driving control method according to a preferred embodiment of the present invention.

Referring to FIG. 5 together with FIG. 2, first, if an operation power is supplied through the power source 110, the driving controller 140 reads the information stored in the internal memory (S10). Then, the driving controller 140 determines the kind of an ECD (S20). If the ECD is a memory type ECD, the driving controller 140 switches the coloring timer 131 and the decoloring timer 132 into continuing time setting timers (S30). On the contrary, if the ECD is a non-memory type ECD, the driving controller 140 switches the coloring timer 131 and the decoloring timer 132 into bypass timers (S40).

In the memory type driving mode, the driving controller 140 checks whether there is an input of an ECD control signal from outside (S50). If there is an input of an ECD control signal, the driving controller 140 determines whether the ECD control signal is a coloring control signal or a decoloring control signal (S60).

Figure 6:
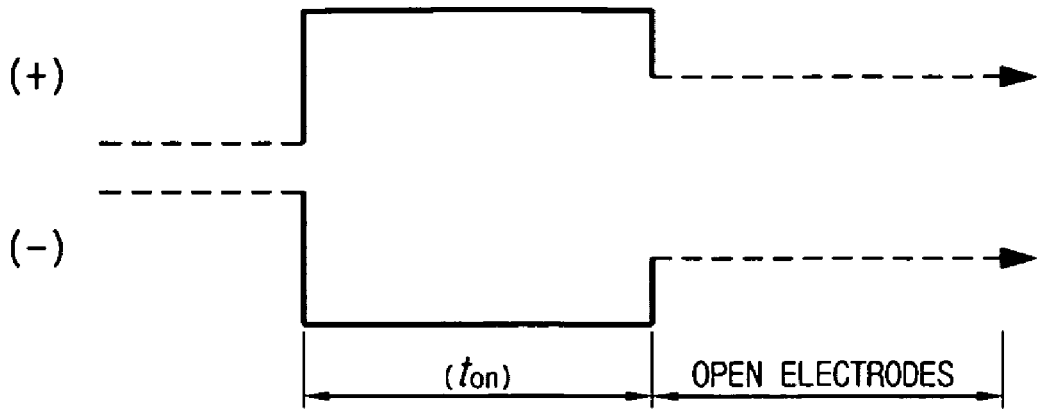
FIG. 6 shows voltage levels applied to upper and lower electrodes of an ECD when the ECD is colored in a memory type driving mode.

As a result, if the ECD control signal is a coloring control signal, the driving controller 140 outputs a coloring signal to the driving voltage output unit 120 (S70). Then, as shown in FIG. 6, the upper electrode output unit 121 of the driving voltage output unit 120 outputs a high level voltage (VCC), and the lower electrode output unit 122 of the driving voltage output unit 120 outputs a low level voltage (GND) such that the high and low level voltages are respectively applied to upper and lower electrodes of the ECD (S80). Accordingly, the ECD is colored. Meanwhile, the coloring timer 131 of the timer 130 counts a time from the point that the high level voltage (VCC) is applied to the upper electrode (S90). In parallel to that, the coloring timer 131 determines whether the time counted by the coloring timer 131 reaches a preset coloring continuing time $t_{on}$ (se FIG. 6) (S100). If the counted time reaches the coloring continuing time, the coloring timer 131 outputs a voltage application completion signal to the driving controller 140 (S110). On the contrary, if the counted time does not reach the coloring continuing time, the coloring timer 131 keeps the time counting operation. If the voltage application completion signal is output in the step S110, the driving controller 140 outputs an electrode opening signal to the driving voltage output unit 120 (S120). Then, as shown in FIG. 3, the driving voltage output unit 120 applies low level voltage (GND) to all transistor bases such that outputs of Q2 and Q4 are floated to open both electrodes of the ECD (S130). Accordingly, the ECD keeps a colored state. Then, the process returns to the step S50.

Figure 7:
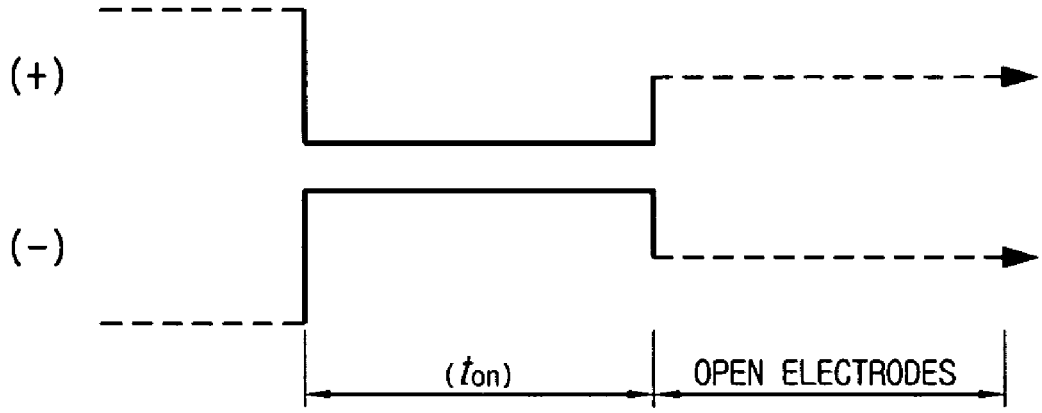
FIG. 7 shows voltage levels applied to upper and lower electrodes of an ECD when the ECD is decolored in a memory type driving mode.

Meanwhile, if the ECD control signal is determined as a decoloring control signal in the step S60, the driving controller 140 outputs a decoloring signal to the driving voltage output unit 120 (S140). Then, as shown in FIG. 7, the upper electrode output unit 121 of the driving voltage output unit 120 outputs a low level voltage (GND), and the lower electrode output unit 122 of the driving voltage output unit 120 outputs a high level voltage (VCC) such that the low and high level voltages are respectively applied to the upper and lower electrodes of the ECD (S150). Accordingly, the ECD is decolored. Meanwhile, the decoloring timer 132 of the timer 130 counts a time from the point that the high level voltage (VCC) is applied to the lower electrode (S160). Also, in parallel to that, the decoloring timer 132 determines whether the counted time reaches a preset decoloring continuing time $t_{on}$ (see FIG. 7) (S170). As a result, if the counted time reaches the decoloring continuing time, the decoloring timer 132 outputs a voltage application completion signal to the driving controller 140 (S180). Meanwhile, if the counted time does not reaches the decoloring continuing time, the decoloring timer 132 keeps the time counting operation. If the voltage application completion signal is output in the step S180, the driving controller 140 outputs an electrode opening signal to the driving voltage output unit 120 (S190). Then, as shown in FIG. 3, a low level voltage (GND) is applied to all transistor bases such that outputs of Q2 and Q4 are floated to open both electrodes of the ECD (S200). Accordingly, the ECD keeps its decolored state. Also, the process returns to the step S50.

It would be apparent to those having ordinary skill in the art that the coloring and decoloring processes of the ECD as mentioned above may be repeated whenever an ECD control signal is applied to the driving controller 140.

Then, a coloring or decoloring process conducted in a non-memory driving mode after the timer 130 is switched into a corresponding function will be explained. First, after the timer 130 is switched into a bypass timer, the driving controller 140 checks whether there is an input of an ECD control signal from outside (S210). If there is an input of an ECD control signal, the driving controller 140 determines whether the ECD control signal is a coloring control signal or a decoloring control signal (S220).

As a result, if the ECD control signal is a coloring control signal, the driving controller 140 outputs a coloring signal to the driving voltage output unit 120 (S230). Then, the upper electrode output unit 121 of the driving voltage output unit 120 outputs a high level voltage (VCC) and the lower electrode output unit 122 of the driving voltage output unit 120 outputs a low level voltage (GND) such that the high and low level voltages are respectively applied to the upper and lower electrodes of the ECD (S240). Accordingly, the ECD is colored. At this time, the timer 130 is switched into a bypass timer, so the timer 130 does not outputs a voltage application completion signal to the driving controller 140. Thus, the driving controller 140 continuously applies the coloring signal to the driving voltage output unit 120, and as a result the coloring voltage is continuously applied to the upper and lower electrodes of the ECD, thereby keeping a colored state. Meanwhile, the process returns to the step S210, and the coloring voltage is continuously applied until another ECD control signal is input.

Meanwhile, if the ECD control signal is determined as a decoloring control signal in the step S220, the driving controller 140 outputs a decoloring signal to the driving voltage output unit 120 (S250). Then, the upper electrode output unit 121 of the driving voltage output unit 120 outputs a low level voltage (GND), and the lower electrode output unit 122 of the driving voltage output unit 120 outputs a high level voltage (VCC) such that the low and high level voltages are respectively applied to the upper and lower electrodes of the ECD (S260). Accordingly, the ECD is decolored. At this time, since the timer 130 is switched as a bypass timer, the timer 130 does not output a voltage application completion signal to the driving controller 140. Thus, the driving controller 140 continuously applies the decoloring voltage to the driving voltage output unit 120, and as a result the decoloring voltage is continuously applied to the upper and lower electrodes of the ECD, thereby keeping the decolored state. Meanwhile, the process returns to the step S210, and the decoloring voltage is continuously applied until another ECD control signal is input.

Figure 8:
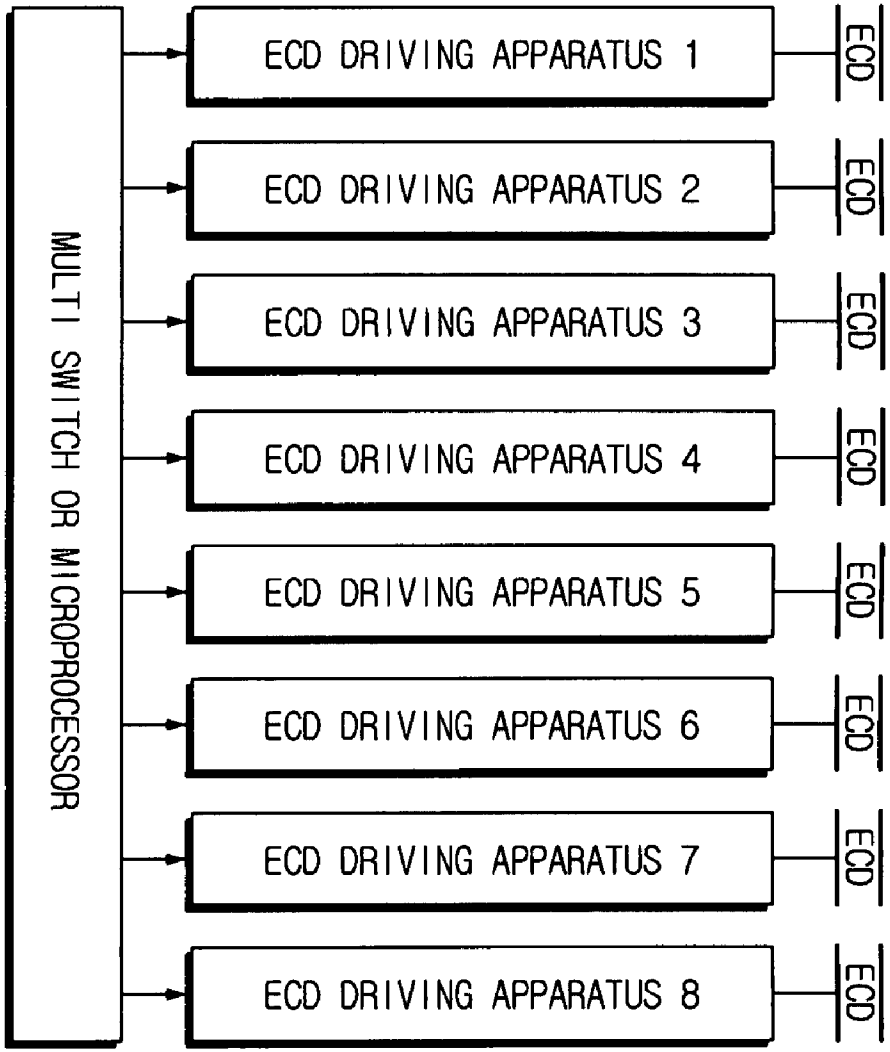
FIG. 8 is a block diagram schematically showing an ECD driving apparatus capable of driving a plurality of ECDs at the same time.

The ECD driving device configured as above according to the present invention may be applied to rearview mirrors of vehicle, sunroofs, smart windows, outside displays and so on. In addition, the present invention may also be applied to the case that several ECDs are combined and then operated at once in a cell unit, as shown in FIG. 8. That is to say, if a plurality of ECD driving apparatuses are combines and then an ECD control signal is individually applied to a driving controller of each driving apparatus using a multi switch or microcontroller, the plurality of ECDs may be colored or decolored at once in a cell unit.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

According to the present invention, a memory type ECD and a non-memory type ECD may be driven together using only one ECD driving apparatus. Also, by using the timer whose driving mode may be switched, the apparatus of the present invention may control a memory type ECD and a non-memory type ECD together with a simplified configuration compared with its functions. In addition, electric charges are not excessively accumulated in an electrolytic layer when driving a memory type ECD, thereby capable of relieving stress of the electrolytic layer. Accordingly, it is possible to extend the life cycle of the ECD and prevent unnecessary power consumption.

The invention claimed is:

1. An apparatus for driving an electrochromic device (ECD), comprising:

a driving voltage output unit for selectively applying a coloring voltage or a decoloring voltage between upper and lower electrodes of an ECD;

a timer for counting an applying time of the coloring or decoloring voltage in a memory type driving mode and then outputting a voltage application completion signal after the counted time exceeds a preset time, the timer bypassing the counting operation in a non-memory type driving mode; and a driving controller for selectively inputting a coloring signal or a decoloring signal to the driving voltage output unit such that the driving voltage output unit is controlled to output a coloring or decoloring voltage corresponding to the signal, the driving controller receiving the voltage application completion signal to stop the input of the coloring or decoloring signal, wherein the timer includes:

a coloring timer for counting a voltage applying time when the coloring voltage is applied to the upper and lower electrodes of the ECD and then outputting a voltage application completion signal in case the counted voltage applying time reaches a preset coloring continuing time in the memory type driving mode, the coloring timer bypassing the time counting operation in the non-memory type driving mode; and a decoloring timer for counting a voltage applying time when the decoloring voltage is applied to the upper and lower electrodes of the ECD and then outputting a voltage application completion signal when the counted voltage applying time reaches a preset decoloring continuing time in the memory type driving mode, the decoloring time bypassing the time counting operation in the non-memory type driving mode.

2. The apparatus for driving an ECD according to claim 1, wherein the driving voltage output unit includes:

an upper electrode output unit for applying a high level voltage for the coloring signal and a low level voltage for the decoloring signal to the upper electrode of the ECD; and a lower electrode output unit for applying a low level voltage for the coloring signal and a high level voltage for the decoloring signal to the lower electrode of the ECD.

3. The apparatus for driving an ECD according to claim 2, wherein the driving controller outputs an electrode opening signal to the driving voltage output unit in response to the voltage application completion signal, and wherein, in response to the electrode opening signal, the driving voltage output unit floats the upper and lower electrodes to open the electrodes of the ECD.

4. The apparatus for driving an ECD according to claim 1, wherein the timer is switched into a continuing time setting timer in the memory type driving mode and switched into a bypass timer in the non-memory driving mode.

5. The apparatus for driving an ECD according to claim 1, wherein the coloring timer includes:

a voltage input terminal to which the coloring voltage applied to the ECD is detected and input;

a continuing time setting timer for counting a time from a voltage applying point when the coloring voltage is applied and then outputting a voltage application completion signal when the counted time reaches a preset coloring continuing time;

a bypass timer for bypassing the time counting operation and not outputting a voltage application completion signal though the coloring voltage is applied;

a timer selection switch for switching the voltage input terminal into the continuing time setting timer in the memory type driving mode and switching the voltage input terminal into the bypass timer in the non-memory driving mode according to the control of the driving controller; and a signal output terminal for applying the voltage application completion signal to the driving controller.

6. The apparatus for driving an ECD according to claim 5, wherein the coloring voltage detected through the voltage input terminal is a high level voltage applied to the upper electrode of the ECD.

7. The apparatus for driving an ECD according to claim 1, wherein the decoloring timer includes:

a voltage input terminal to which the decoloring voltage applied to the ECD is detected and input;

a continuing time setting timer for counting a time from a voltage applying point when the decoloring voltage is applied and then outputting a voltage application completion signal when the counted time reaches a preset decoloring continuing time;

a bypass timer for bypassing the time counting operation and not outputting a voltage application completion signal though the decoloring voltage is applied;

a timer selection switch for switching the voltage input terminal into the continuing time setting timer in the memory type driving mode and switching the voltage input terminal into the bypass timer in the non-memory driving mode according to the control of the driving controller; and a signal output terminal for applying the voltage application completion signal to the driving controller.

8. The apparatus for driving an ECD according to claim 7, wherein the decoloring voltage detected by the voltage input terminal is a high level voltage applied to the lower electrode of the ECD.

9. The apparatus for driving an ECD according to claim 1, further comprising a memory of storing ECD type information, wherein the driving controller reads the ECD type information stored in the memory and then switches the timer into a continuing time setting timer in case the ECD is a memory type ECD and switches the timer into a bypass timer in case the ECD is a non-memory type ECD.

10. An ECD driving control method using a timer that counts an applying time of a coloring or decoloring voltage applied between upper and lower electrodes of an ECD and then outputs a voltage application completion signal when the counted applying time exceeds a preset time in a memory type driving mode, and bypasses the counting operation in a non-memory type driving mode, the method comprising:

(a) selecting a driving mode of the timer according to a type of the ECD;

(b) selectively applying a coloring or decoloring voltage between the upper and lower electrodes of the ECD;

(c) monitoring whether the timer outputs the voltage application completion signal; and (d) stopping the application of the coloring or decoloring voltage when the voltage application completion signal is output from the timer, and keeping the application of the coloring or decoloring voltage when the counting operation of the timer is bypassed.

11. The ECD driving control method according to claim 10, wherein the step (a) includes: (a1) reading a type of the ECD stored in a memory; and (a2) setting a driving mode of the timer to a continuing time setting timer or a bypass timer according to the read type of the ECD.

12. The ECD driving control method according to claim 10, wherein the step (b) includes:

(b1) receiving an ECD control signal;

(b2) determining whether the ECD control signal is a coloring control signal or a decoloring control signal;

(b3) applying a coloring voltage between the upper and lower electrodes of the ECD in case the ECD control signal is a coloring control signal, and applying a decoloring voltage between the upper and lower electrodes of the ECD in case that the ECD control signal is a decoloring control signal.

13. The ECD driving control method according to claim 12, wherein, in the step (b3), in case the ECD control signal is a coloring control signal, a high level voltage and a low level voltage are respectively applied to the upper and lower electrodes of the ECD, while, in case the ECD control signal is a decoloring control signal, a low level voltage and a high level voltage are respectively applied to the upper and lower electrodes of the ECD.

14. The ECD driving control method according to claim 12, wherein, in the step (b1), the ECD control signal is received from a switch or a microcontroller.

15. The ECD driving control method according to claim 10, wherein, in the step (d), when the voltage application completion signal is output from the timer, the upper and lower electrodes of the ECD are floated to open the electrodes.

* * * * *